United States Patent [19]

Lonardi

[11] Patent Number: 4,815,696

[45] Date of Patent: Mar. 28, 1989

[54] MECHANISM FOR OPERATING A METERING VALVE

[75] Inventor: Emile Lonardi, L-Bascharage, Luxembourg

[73] Assignee: Paul Wurth, S.A., Luxembourg, Luxembourg

[21] Appl. No.: 123,022

[22] Filed: Nov. 19, 1987

[30] Foreign Application Priority Data

Nov. 21, 1986 [LU] Luxembourg ..... 86679

[51] Int. Cl.[4] ..... F16K 31/122

[52] U.S. Cl. ..... 251/58; 74/471 R; 74/519; 91/363 R; 222/52; 251/212; 251/229; 251/232; 251/279; 364/183; 364/167.01

[58] Field of Search ..... 251/57, 58, 28, 229, 251/212, 129.01, 129.04, 232, 279, 280; 91/361, 363 R; 364/167, 183; 222/52, 64; 414/169, 200, 221; 74/471 R, 519

[56] References Cited

U.S. PATENT DOCUMENTS

| | | | |
|---|---|---|---|
| 2,781,743 | 2/1957 | Mann et al. | 91/363 R |
| 3,038,449 | 6/1962 | Murphy, Jr. et al. | 91/363 R |
| 3,149,642 | 9/1964 | Marx | 251/58 |
| 3,317,179 | 5/1967 | Willis | 251/58 |
| 3,902,694 | 9/1975 | Friedell | 251/58 |
| 3,998,426 | 12/1976 | Isbester | 251/212 |
| 4,037,519 | 7/1977 | Miller et al. | 91/361 |
| 4,158,367 | 6/1979 | Mailliet | 251/58 |
| 4,513,782 | 4/1985 | Contartese et al. | 91/363 R |
| 4,514,129 | 4/1985 | Legille et al. | 251/212 |
| 4,570,900 | 2/1986 | Lonardi et al. | 251/58 |
| 4,694,390 | 9/1987 | Lee | 364/167 |

FOREIGN PATENT DOCUMENTS

| | | | |
|---|---|---|---|
| 1055606 | 2/1954 | France | 251/212 |
| 1147940 | 12/1957 | France | 251/212 |
| 2154803 | 5/1973 | France . | |
| 0038875 | 4/1978 | Japan | 91/361 |
| 1120278 | 7/1968 | United Kingdom . | |

*Primary Examiner*—George L. Walton

*Attorney, Agent, or Firm*—Fishman, Dionne & Cantor

[57] ABSTRACT

A metering valve comprised of two rotary registers are each provided with cutouts which are symmetrical in relation to the axis of the central opening defined by the movement of the registers. In accordance with the present invention, a mechanism for operating the registers synchronously and in opposite directions is composed of levers and connecting rods acting on the axis of suspension and rotation of the registers through the action of, for example, hydraulic jacks. In order to avoid the offsetting of the flow because of the difference between the radii of curvature of the registers, one of the connecting rods acting on the axis of the registers is adjustable in length.

8 Claims, 5 Drawing Sheets

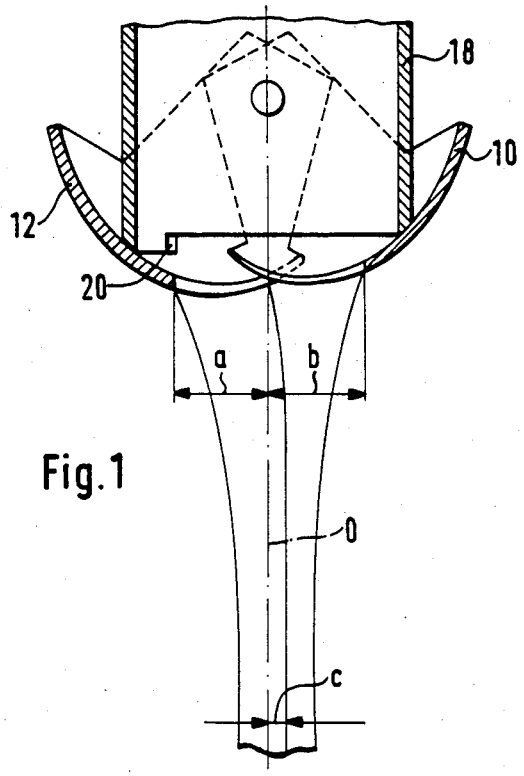
Fig. 1
Fig. 2
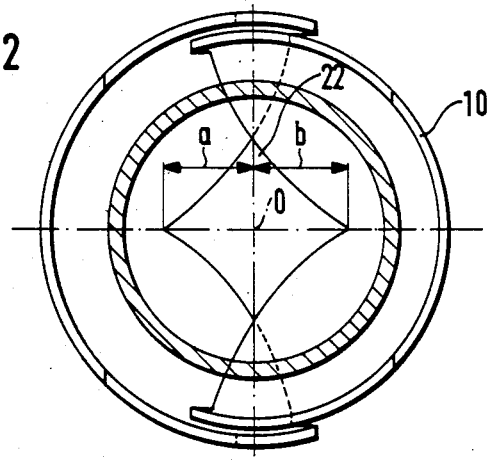

MECHANISM FOR OPERATING A METERING VALVE

BACKGROUND OF THE INVENTION

This invention relates to a mechanism for operating a metering valve comprising two rotary registers shaped as spherical or cylindrical domes and provided with cutouts which are symmetrical in relation to the axis of a central opening defined by the movement of the registers and cutouts. The registers are fastened to two drive shafts disposed coaxially in relation to one another and received in the bearings of a flow tube. By pivoting about their common axis, each of the registers are operated synchronously and in opposite directions. Each of the two shafts is provided with an arm, each arm being articulated by means of a connecting rod on a rocking lever mounted on a pivot axis parallel to the common axis of the two shafts. The rocking levers are connected to drive device pivoting them about their pivot axis. The articulation between one of the rocking levers and its connecting rod is angularly offset about the pivot axis in relation to the articulation between the other rocking lever and its connecting rod.

A mechanism of the type contemplated by the present invention is described in European Pat. No. 0,134,918, corresponding to U.S. Pat. No. 4,570,900, assigned to the assignee hereof, all of the contents of which are incorporated herein by reference. U.S. Pat. No. 4,570,900 discloses an apparatus for regulating the flow of charge material from a storage container disposed on the central axis of a shaft furnace charging plant. This prior device discloses means for controlling the registers in such a manner that the flow opening delimited by the cutout, will be modified symmetrically in relation to the central axis.

The use of the metering system of U.S. Pat. No. 4,570,900 results in a certain irregularlity in the level of the charging surface of the furnace. This irregularity has, in addition, been confirmed by tests. The tests have shown that these irregularities are due to the offsetting (in relation to the vertical axis), of the flow of charge material flowing through a symmetrical opening defined between the two registers. It is true that this offset is very slight and that its effect on the charging profile varies in accordance with the angular position of the spout. However, since the same effects always occur in the same angular positions (viewed in plan) of the spout, the accumulation of these irregularities as successive deposited layers finally gives rise to a non-negligible deviation from the charge level profile which it is desired to obtain.

It has been found that the cause of this offset of the flow current is due to the difference in the curvature of the domes of the two registers, one of which must have a radius greater than that of the other. It will be appreciated that this offsetting phenomenon will be better understood and described in greater detail further on, in connection with the drawings.

SUMMARY OF THE INVENTION

The above-discussed and other problems and deficiencies of the prior art are overcome or alleviated by the apparatus of the present invention which provides an improved mechanism for enabling the offset of the flow current to be eliminated regardless of the angular positions of the two registers.

In accordance with the present invention, a metering apparatus of the type comprising two rotary spherically or cylindrically shaped registers with cutouts which are symmetrical with respect to a central opening defined by the movement of the registers is provided wherein one of the connecting rods is adjustable in length. The adjustment of this connecting rod is preferably effected by the use of a hydraulic jack incorporated in the connecting rod.

The present invention also provides a control circuit incorporating a first detector for the angular position of the register whose connecting rod is not adjustable, a second detector for the actual position of the jack, a comparator comparing the actual position of the jack with a stored set position dependent on the angular position of the register and a hydraulic valve whose control is dependent on the result of the comparison made by the comparator. The hydraulic valve operates the jack until the actual position of the jack corresponds to the set position.

The apparatus of the present invention thus makes it possible to automatically modify the orientation of the registers in relation to the central axis so that the flow is symmetrical to said axis.

The above discussed and other features and advantages of the present invention will be appreciated and understood by those of ordinary skill in the art from the following detailed description and drawings.

BRIEF DESCRIPTION OF THE DRAWINGS

Referring now to the drawings, wherein like elements are numbered alike in the several FIGURES:

FIG. 1 is a cross sectional elevation view through a metering valve operated in accordance with the prior art;

FIG. 2 is a plan view of the prior art valve shown in FIG. 1;

DESCRIPTION OF THE PREFERRED EMBODIMENT

Figure 3:
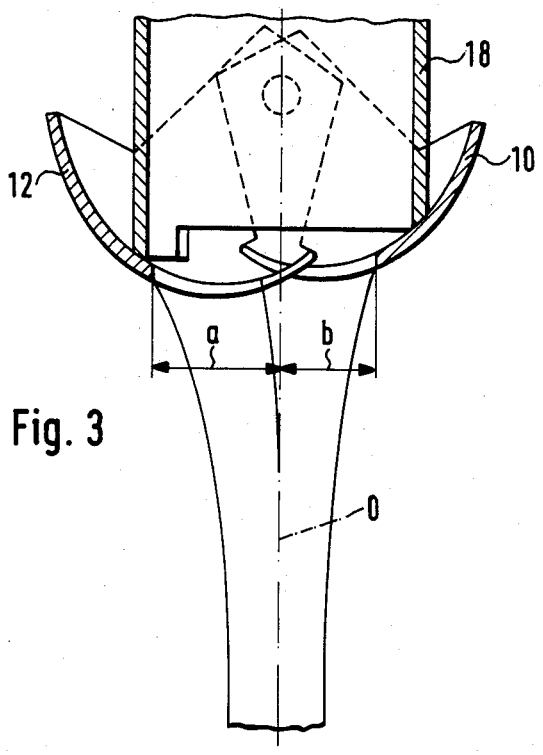
FIG. 3 is a cross sectional elevation view of a valve operated by the mechanism in accordance with the present invention.

FIGS. 1 and 2 show a conventional metering valve of the type disclosed in the above mentioned U.S. Pat. No. 4,570,900. This valve comprises two registers 10 and 12 having the shape of a spherical dome and adapted to pivot in opposite directions about a common axis under a flow tube 18. The two registers 10 and 12 have triangular cutouts, and the mechanism for operating these registers is designed in such a manner as to pivot the registers in opposite directions in order to form a flow opening 22 which is substantially square in shape and perfectly symmetrical in relation to the central axis 0. In other words, the horizontal distances a and b from the bottom of each of the register cutouts to the central axis 0 are equal to one another whatever the angular position of registers 10 and 12. As FIG. 1 shows, tests have revealed that a symmetrical opening produces a flow which is asymmetrical inasmuch as the flow current is offset by a distance c from the central axis 0. This offset appears to be caused by the fact that the registers must have different radii of curvature. In the example illustrated, register 12 has the larger radius of curvature, which can be seen from the step 20 on the bottom edge of tube 18. The curvature of reigster 10 is therefore less than that of the register 12. As FIG. 1 shows, the offset of the flow current occurs on the opposite side to that where the register having the larger radius of curvature is positioned. It therefore seems that the register having the smaller radius of curvature has a greater braking effect, or inversely that the register having the larger radius of curvature contributes towards a freer flow.

Figure 4:
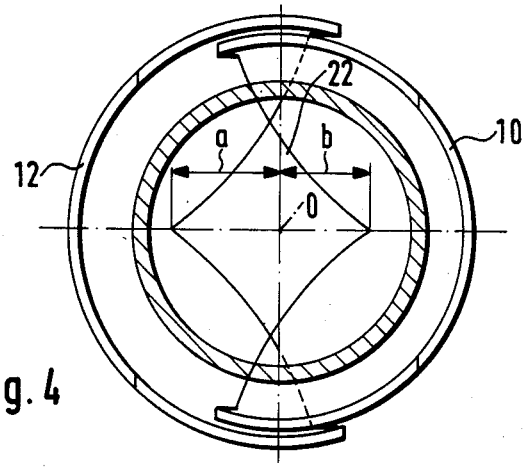
FIG. 4 is a cross sectional elevation view of the valve of FIG. 3.

Referring now to FIGS. 3 and 4, in accordance with the present invention, this phenomenon is eliminated by increasing the angle of opening of register 12 relative to the angle opening of register 10 (the register having the smaller radius). In other words, the present invention increases the distance a in relation to the distance b. As a result, the flow opening 22 shown in projection in FIG. 4 becomes asymmetrical in relation to the central axis 0, but the flow current will be formed symmetrically around said axis, as shown in FIG. 3.

Figure 7:
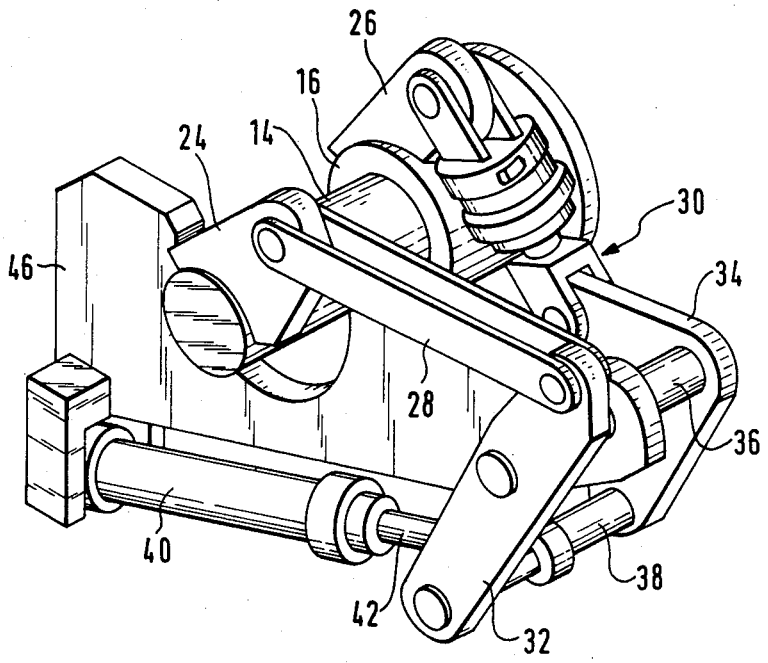
FIG. 7 is a perspective view of the metering valve operating mechanism of the present invention.

The mechanism in accordance with the present invention which is employed to pivot the two registers 10 and 12 will be described with reference to the following FIGURES. However, a brief description of the valve operating mechanism will first be given with reference to FIGS. 5 and 7, this mechanism being similar to that proposed by the above mentioned U.S. Pat. No. 4,570,900, to which reference should be made for more detail.

The top register 10 having the smaller radius is fastened to a drive shaft 14 disposed coaxially inside a second drive shaft 16 to which the lower register 12 is fastened. These two shafts 14 and 16 pass through flow tube 18. The two shafts 14 and 16 are adapted to turn relative to one another about their common axis and relative to tube 18 because of the interposition of bushes or bearings known per se (not shown).

Shafts 14 and 16 are fastened respectively to arms 24 and 26, each of which is articulated to one end of a connecting rod 28, 30. The opposite ends of these two connecting rods 28 and 30 are in turn articulated respectively to one end of two rocking levers 32 and 34 mounted on a common pin 36 parallel to the axis of rotation of the two drive shafts 14 and 16 and adapted to pivot about said common pin 36. These two rocking levers 32, 34 are connected together at their other ends by means of a rod 38, so that levers 32 and 34 must necessarily pivot together about the pin 36. In order to increase strength, it is preferable for levers 32 and 34 to be welded together by means of braces (not shown).

The pivoting of rocking levers 32 and 34 is brought about by a hydraulic cylinder or jack 40, which is pivotally mounted on a pivot 44 carried by a support plate 46 fastened to tube 18. Rod 38 connecting together the two levers 32 and 34 passes through the end of rod 42 of jack 40.

Figure 5:
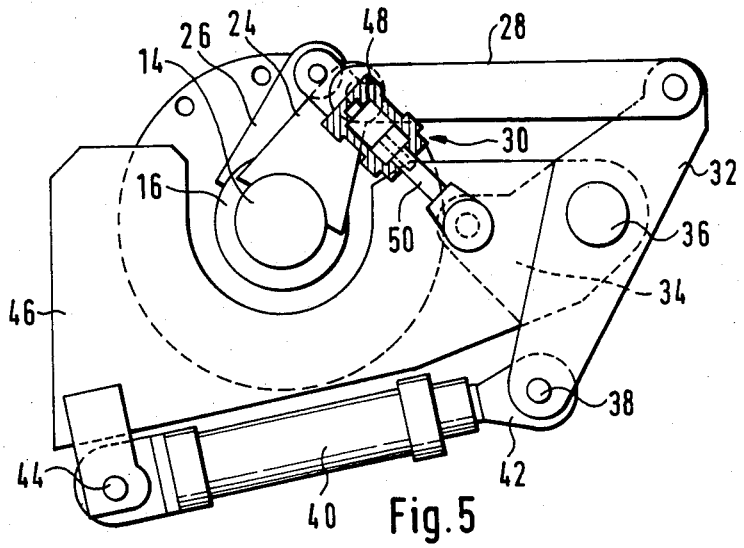
FIG. 5 is a side elevation view, partly in cross section, of the metering valve operating mechanism of the present invention in a first angular position.
Figure 6:
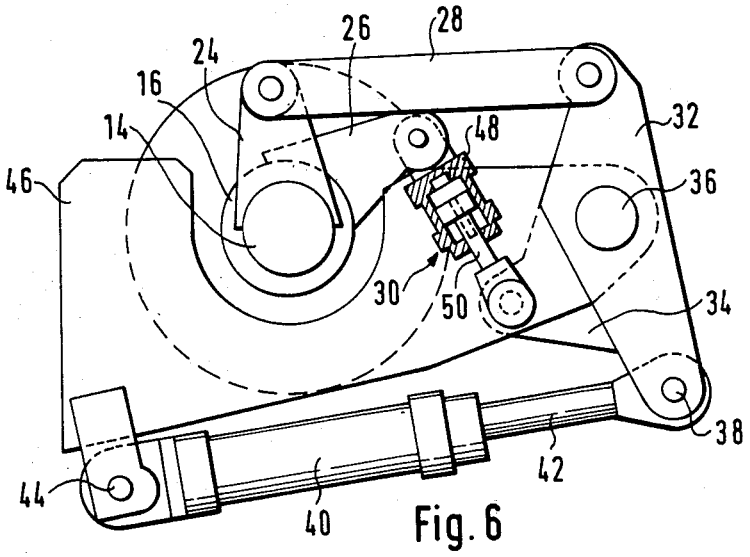
FIG. 6 is a side elevation view, partly in cross section, of the metering vlave operating mechanism of the present invention in a second angular position.

FIG. 5 shows the mechanism of the present invention in the position in which the valves (e.g. registers) are closed, while the arrangement shown in FIG. 6, resulting from the extension of rod 42 of jack 40, corresponds to the opening of the valve through the pivoting of arms 24 and 26 in opposite directions.

In accordance with an important feature of the present invention, connecting rod 30 operating register 12 (which has the longer radius) is adjustable in length. For this purpose, connecting rod 30 is constructed in the form of a hydraulic jack whose cylinder 48 is articulated to arm 26, while cylider rod 50 is articulated to lever 34, or vice versa. On the operation of the valve, rod 50 is retracted into cylinder 48, as shown in FIG. 6, which has the effect of reducing the length of connecting rod 30 and increasing the pivoting angle of register 12.

Figure 8:
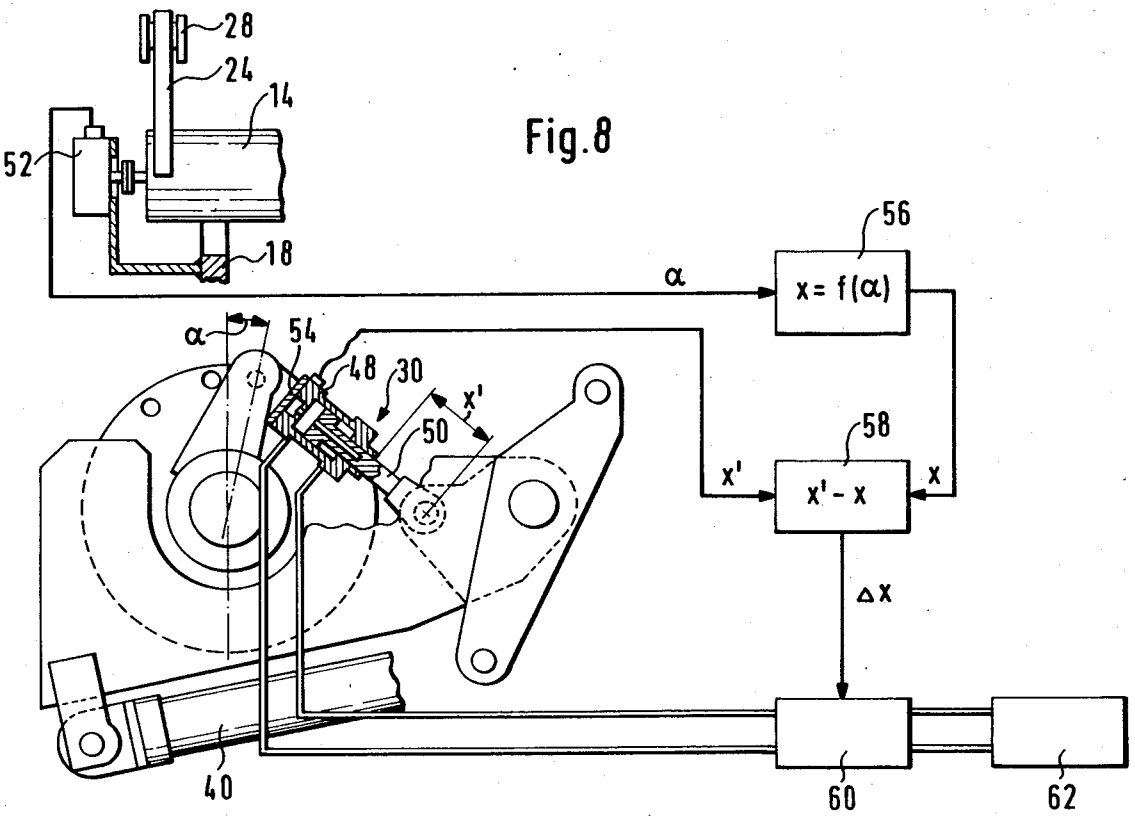
FIG. 8 is a block diagram of the control circuit for use with the metering valve operating mechanism of the present invention.

FIG. 8 shows a control circuit for the adjustment of the length of connecting rod 30 in response to the angular position of register 12. An angular position detector 52, known per se, is associated with shaft 14 to permanently indicate the angular position $\alpha$ of register 10 in relation to a reference position, for example, the central axis 0. This information is transmitted to a memory 56, in which set value information is stored for the optimum opening angle of register 12 in response to the angular position of register 10 for different types of materials. This information is obtained by previous tests and relates to the length of connecting rod 30, that is, the extension length X of rod 50 of jack 48 incorporated in connecting rod 30. The memory 56 thus establishes the desired values X of the amplitude of the extension of rod 50 in response to the angular positions X measured by detector 52. This information is transmitted to a comparator 58. The latter also receives, from a detector 54 incorporated in cylinder 48, information concerning the actual amplitude X' of the extension of rod 50. Comparator 58 controls a hydraulic valve 60 which regulates the rate of flow and direction of circulation of the hydraulic fluid between a pump 62 and cylinder 54.

If comparator 68 detects a difference $\Delta X$ between the desired value position X and the actual position X', the valve 60 is operated to circulate the hydraulic fluid in the appropriate direction to reduce the difference $\Delta X$ and make the actual position X' correspond to the desired value position X. For example, if the register 12 is not sufficiently open, X' will be greater than X. In this case, valve 60 will deliver hydraulic fluid into the piston rod compartment to retract rod 50 and reduce the amplitude of X' until equality with the desired value X is achieved.

The arrangement shown in FIG. 8 permits two different modes of operation. It is possible to open register 12 with the aid of cylinder 54 without moving register 10, until the desired value position stored in memory 56 is reached, without this being response to the opening angle $\alpha$. Once the desired value position of register 12 is reached, the action on cylinder 54 is terminated and the hydraulic jack 40 is operated to move the two registers 10 and 12 in synchronism and in opposite directions. In the second operating mode, jack 40 is operated from the start to open the two registers 10 and 12 at the same time. However, the opening speed of the register 12 is increased progressively by means of cylinder 54 and in response to the opening angle $\alpha$ of the register 10, in accordance with the desired values stored in 56. Starting from the maximum opening position of register 12, as illustrated in FIG. 3, it is possible, in order to be able to open register 10 completely, to operate jack 60 in the opposite direction so as to prevent register 12 from striking against tube 18.

One advantage of the apparatus of the present invention is that it can be retrofit to existing mechanisms of the type described in previously mentioned U.S. Pat. No. 4,570,900, without modifying other mechanical components. Another advantage is that it can be adapted to the characteristics of different charge materials.

Yet another advantage of the present invention is that the operator is enabled to intervene with respect to the centering of the flow current while the blast furnace is in operation. In other words, the operator can, with the aid of measuring apparatus of a suitable type, determine the degree of uniformity of the chrage deposited in the furnace and take appropriate action with respect to the metering valve.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. An apparatus for operating a metering valve comprising first and second rotary registers provided with cutouts which are symmetrical with respect to a vertical axis of a central opening defined by the movement of the first and second registers and cutouts, the first and second registers being fastened respectively to first and second drive shafts disposed coxially in relation to one another and received in bearings of a flow tube such that by pivoting about their common axis, each of the registers operates synchronously and in opposite directions, and further comprising:

first arm means provided to said first drive shaft;

second arm means provided to said second drive shaft;

first connecting rod means pivotably connected to a first rocking lever means, said first rocking lever means being pivotably mounted on a pivot axis, said pivot axis being parallel to the common axis of said first and second drive shafts, said first arm means being articulated to said first connecting rod means;

second connecting rod means pivotally connected to a second rocking lever means, said second rocking lever means being pivotably mounted on a pivot axis, said pivot axis being parallel to the common axis of said first and second drive shafts, said second arm means being articulated to said second connecting rod means;

drive means, said first and second rocking lever means being pivotably connected to said drive means wherein said drive means pivots said first and second rocking lever means about said pivot axis;

wherein the connection between said first rocking lever means and said first connecting rod means is angularly offset about said pivot axis in relation to the connection between said second rocking lever means and said second connecting rod means; and either said first or second connecting rod means includes adjusting means for selectively adjusting the length of said first rod means for modifying the orientation of one of said registers with respect to said vertical axis in order to maintain a symmetrical flow to said vertical axis.

2. The apparatus of claim 1 wherein said adjusting means comprises:

hydraulic cylinder means incorporated in said first connecting rod means.

3. The apparatus of claim 2 including:

control circuit means for controlling said hydraulic cylinder means.

4. The apparatus of claim 3 wherein said control circuit means comprises:

first detector means for detecting the angular position of said second register;

second detector means for detecting the actual position of said hydraulic cylinder means;

comparator means fior comparing the actual position of said hydraulic cylinder means with a stored set position in response to the angular position of said first register as indicated by said first detector means;

hydraulic valve means for operating said hydraulic cylinder means until the actual position of said hydraulic cylinder means corresponds to the stored set position based on the comparison made by said comparator means.

5. In a apparatus for operating a metering valve comprising first and second rotary registers provided with cutouts which are symmetrical with respect to a verticl axis of a central opening defined by the movement of the registers and cutouts, the first and second registers being fastened respectively to first and second drive shafts disposed coaxially in relation to one another and received in bearings of a flow tube such that by pivoting about their common axis, each of the registers operates synchronously and in opposite directions, and further comprising first arm means provided to said first drive shaft, second arm means provided to said second drive shaft, first connecting rod means pivotably connected to a first rocking lever means, said first rocking lever means being pivotably mounted on a pivot axis, said pivot axis being parallel to the common axis of said first and second drive shafts, said first arm means being articulated to said first connecting rod means, second connecting rod means pivotally connected to a second rocking lever means, said second rocking lever means being pivotably mounted on a pivot axis, said pivot axis being parallel to the common axis of said first and second drive shafts, said second arm means being articulated to said second connecting rod means, drive means, said first and second rocking lever means being pivotably connected to said drive means wherein said drive means pivots said first and second rocking lever means about said pivot axis, the connection between said first rocking lever means and said first connecting rod means being angularly offset about said pivot axis in relation to the connection between said second rocking lever means and said second connecting rod means, the improvement comprising:

said first or second connecting rod means including adjusting means for selectively adjusting the length of said first rod means for modifying the orientation of one of said registers with respect to said vertical axis in order to maintain a symmetrical flow to said vertical axis.

6. The apparatus of claim 5 wherein said adjusting means comprises:

hydraulic cylinder means incorporated in said first connecting rod means.

7. The apparatus of claim 6 including:

control circuit means for controlling said hydraulic cylinder means.

8. The apparatus of claim 7 wherein said control circuit means comprises:

first detector means for detecting the angular position of said second register;

second detector means for detectingthe actual position of said hydraulic cylinder means;

comparator means for comparing the actual position of said hydraulic cylinder means with a stored set position in response to the angular position of said first register as indicated by said first detector means;

hydraulic valve means for operating said hydraulic cylinder means until the actual position of said hydraulic cylinder means corresponds to the stored set position based on the comparison made by said comparator means.

* * * * *